US010195476B2

(12) United States Patent
Jennings et al.

(10) Patent No.: US 10,195,476 B2
(45) Date of Patent: Feb. 5, 2019

(54) WEIGHT BAR AND LOCKING COLLAR

(71) Applicant: THE PROPHET CORPORATION, Owatonna, MN (US)

(72) Inventors: Todd Russell Jennings, Sunfish Lake, MN (US); Christopher Lee Tuma, Mantorville, MN (US); Matthew Allen Nelson, Minneapolis, MN (US)

(73) Assignee: The Prophet Corporation, Owatonna, MN (US)

( * ) Notice: Subject to any disclaimer, the term of this patent is extended or adjusted under 35 U.S.C. 154(b) by 0 days.

(21) Appl. No.: 15/205,480

(22) Filed: Jul. 8, 2016

(65) Prior Publication Data

US 2017/0151460 A1 Jun. 1, 2017

Related U.S. Application Data

(60) Provisional application No. 62/261,064, filed on Nov. 30, 2015.

(51) Int. Cl.

| | |
|---|---|
| ***A63B 21/072*** | (2006.01) |
| ***A63B 21/075*** | (2006.01) |
| *A63B 71/06* | (2006.01) |

(52) U.S. Cl.

CPC ..... *A63B 21/0728* (2013.01); *A63B 21/075* (2013.01); *A63B 21/0724* (2013.01); *A63B 2071/0694* (2013.01)

(58) Field of Classification Search

CPC ..... A63B 21/0728; A63B 21/072

See application file for complete search history.

(56) References Cited

U.S. PATENT DOCUMENTS

| | | | | |
|---|---|---|---|---|
| 4,579,337 | A | 4/1986 | Uyeda | |
| 4,738,446 | A | 4/1988 | Miles | |
| 4,955,603 | A * | 9/1990 | Becker | A63B 21/0728 403/259 |
| 5,062,631 | A | 11/1991 | Dau et al. | |
| 8,864,634 | B2 | 10/2014 | Mikulski | |
| 9,044,642 | B2 | 6/2015 | Mikulski | |
| 2012/0238416 | A1 | 9/2012 | Becker | |

OTHER PUBLICATIONS

Power Systems, Comprehensive Catalog, Spring 2015, p. 80.

Webpage from Wayback Machine website of Eleiko Sport depicting "Powerlock" weightbar, dated Feb. 5, 2015; downloaded on Jul. 22, 2016.

* cited by examiner

*Primary Examiner* — Loan H Thanh
*Assistant Examiner* — Rae Fischer
(74) *Attorney, Agent, or Firm* — Merchant & Gould P.C.

(57) ABSTRACT

A weight bar system includes a weight bar, and two lock collars on each end of the weight bar for holding one or more weights on each end of the weight bar. The ends of the weight bar include circumferentially positioned grooves. A locking collar is engageable with the grooves both in an unlocked and a locked position. The locking collar includes a main body collar including pins which extend in a cross direction relative to the axis and are moveable radially inwardly and outwardly relative to the grooves. A rotatable collar includes a cam surface to move the pins radially inwardly to lock the locking collar to the weight bar. A stationary collar may also be provided to limit rotation of the rotatable collar, and to provide a gripping surface. A space on the lock collar may be provided to press against the weights.

8 Claims, 14 Drawing Sheets

WEIGHT BAR AND LOCKING COLLAR

This application claims priority under 35 U.S.C. § 119(e) to U.S. provisional patent application 62/261,064 filed Nov. 30, 2015, which application is incorporated herein by reference in its entirety.

BACKGROUND

The present invention relates to the use of a weight bar and an element for holding weights on the weight bar during use. There is a need for improvements in the holding element for holding weights on the weight bar so that the weights do not come loose, or do not slide off the weight bar.

SUMMARY

A weight bar system includes a weight bar, and two lock collars on each end of the weight bar for holding one or more weights on each end of the weight bar. The ends of the weight bar include circumferentially positioned grooves. A locking collar is engageable with the grooves both in an unlocked and a locked position. The locking collar includes a main body collar including pins which extend in a cross direction relative to the axis and are moveable radially inwardly and outwardly relative to the grooves. A rotatable collar includes a cam surface to move the pins radially inwardly to lock the locking collar to the weight bar. A stationary collar may also be provided to limit rotation of the rotatable collar, and to provide a gripping surface. A spacer on the lock collar may be provided to press against the weights.

In some embodiments, the weight bar system further includes a stationary collar mounted to the main body collar, wherein the stationary collar limits the amount of rotation of the rotatable collar to a predetermined amount.

In one or more embodiments, the system further includes a cam and a spring, wherein the cam engages the rotatable collar, and wherein the cam presses on the spring which presses on each pin.

In some implementations, the main body collar includes a plurality of transverse slots extending in the cross direction relative to the axis wherein the slots receive the pins, the springs, and the cam elements.

Some systems include exterior gripping portions on the rotating collar.

The gripping portions may include a gripping tab.

Some systems can further include a stationary collar with gripping portions.

In some embodiments, the gripping portions include gripping tabs.

In a further aspect, a weight bar for lifting weights is provided. The weight bar includes a main body portion extending in an axial direction including first and second opposite distal ends and a grasping portion in a middle section between the first and second ends. A first stop member is on the main body spaced from the first end and is adjacent to the grasping portion. A second stop member is on the main body and is spaced from the second end and is adjacent to the grasping portion. The grasping portion is between the first stop member and the second stop member. A first grooved section having at least thirty spaced grooves extends between the first end and the first stop member. A second grooved section having at least thirty spaced grooves extends between the second end and the second stop member.

In one or more embodiments, the first stop member and the first grooved section are part of a first sleeve having an open inner bore, the main body being received within the open inner bore of the first sleeve.

In one or more embodiments, the second stop member and the second grooved section are part of a second sleeve having an open inner bore, the main body being received within the open inner bore of the second sleeve.

In some embodiments, the first sleeve extends axially beyond the first distal end, and the second sleeve extends axially beyond the second distal end.

In some implementations, the grooves in the first grooved section are evenly spaced and occupy a complete extension between the first end and the first stop member. The grooves in the second grooved section are evenly spaced and occupy a complete extension between the second end and the second stop member.

In some embodiments, the first and second stop members project radially outward from the main body further than a radial projection of the first and second grooved sections.

In a further aspect, a locking collar for selectively mounting to a weight bar is provided. The locking collar includes a main body having a generally cylindrical wall with an exterior surface and an interior surface. The main body defines an open interior and includes a plurality of side slots extending through the wall from the exterior surface to the open interior. The open interior is sized to receive a weight bar. The locking collar includes a rotatable collar having an inner ring-shaped surface. The inner ring-shaped surface includes a cam surface with a plurality of radially inward projections and radially outward recesses. The rotatable collar is oriented around and against the exterior surface of the main body. The locking collar includes a plurality of cam assemblies. Each cam assembly is oriented in each of the side slots of the main body. Each cam assembly is movable by the cam surface of the rotatable collar between a locked position and an unlocked position. The locked position includes the cam assembly being prevented from moving radially outwardly from the main body, and the unlocked position includes the cam assembly being free to move radially outwardly from the main body.

In some embodiments, each cam assembly includes a linear pin, a spring, and a cam member. The linear pin is mounted to extend along and through a respective side slot. The spring is between the linear pin and the cam member. The cam member is in engagement with the cam surface of the rotatable collar.

In one or more embodiments, the main body has a central axis, and the side slots are in cross-direction relative to the central axis.

In some embodiments, the locking collar further includes a stationary collar mounted around and against the exterior surface of the main body. The stationary collar limits the amount of rotation of the rotatable collar to a predetermined amount.

The rotatable collar can include a projecting pin, and the stationary collar can include a slot defined in an axial surface of the stationary collar that receives the projecting pin to limit the amount of rotation of the rotatable collar.

In some implementations, the stationary collar includes a radially inwardly projecting key, and the main body includes a slot in the exterior surface sized to receive the key to prevent relative rotation of the stationary collar and the main body.

In some embodiments, there are at least two side slots and two cam assemblies.

In some embodiments, there are not more than six side slots and six cam assemblies.

In some implementations, the rotatable collar includes at least one gripping tab, and the stationary collar includes at least one gripping tab. When each cam assembly is in the locked position, the at least one gripping tab of the rotatable collar aligns with the at least one gripping tab of the stationary collar. When the cam assembly is in the unlocked position, the at least one gripping tab of the rotatable collar misaligns with the at least one gripping tab of the stationary collar.

In some implementations, the rotatable collar includes a pair of spaced gripping tabs, and the stationary collar includes a pair of spaced gripping tabs. When the cam assembly is in the locked position, the pair of gripping tabs of the rotatable collar aligns with the pair of gripping tabs of the stationary collar. When the cam assembly is in the unlocked position, the pair of gripping tabs of the rotatable collar misaligns with the pair of gripping tabs of the stationary collar.

In some embodiments, the gripping tabs of the rotatable collar are about 180° apart, and the gripping tabs of the stationary collar are about 180° apart.

Some implementations of the locking collar further include a spacer connected to the main body and mounted along an axial end of the rotatable collar. The rotatable collar is axially between the spacer and the stationary collar.

In another aspect, a method of mounting a locking collar onto a weight bar is provided. The method includes mounting a weight bar having a main body extending in an axial direction and having distal ends, at least one of the distal ends including a plurality of circumferential grooves. The method includes providing a locking collar having an open passage and a plurality of linear pins projecting radially into the open passage. The method includes mounting the collar around at least one distal end of the weight bar so that the weight bar extends through the open passage. The method includes positioning the locking collar to a desired location along the weight bar with the linear pins projecting into the circumferential grooves. The method includes locking the locking collar to the weight bar by rotating a rotatable collar that moves a cam surface to engage a plurality of cam members against the linear pins to prevent the linear pins from moving radially outwardly.

In some implementations, after the step of locking, there is a step of unlocking the locking collar by rotating the rotatable collar to move the cam surface and disengage the plurality of cam members from the linear pins to allow the linear pins to move radially outwardly.

A variety of additional inventive aspects will be set forth in the description that follows. The inventive aspects can relate to individual features and to combinations of features. It is to be understood that both the forgoing general description and the following detailed description are exemplary and explanatory only and are not restrictive of the broad inventive concepts upon which the embodiments disclosed herein are based.

DETAILED DESCRIPTION

Figure 1:
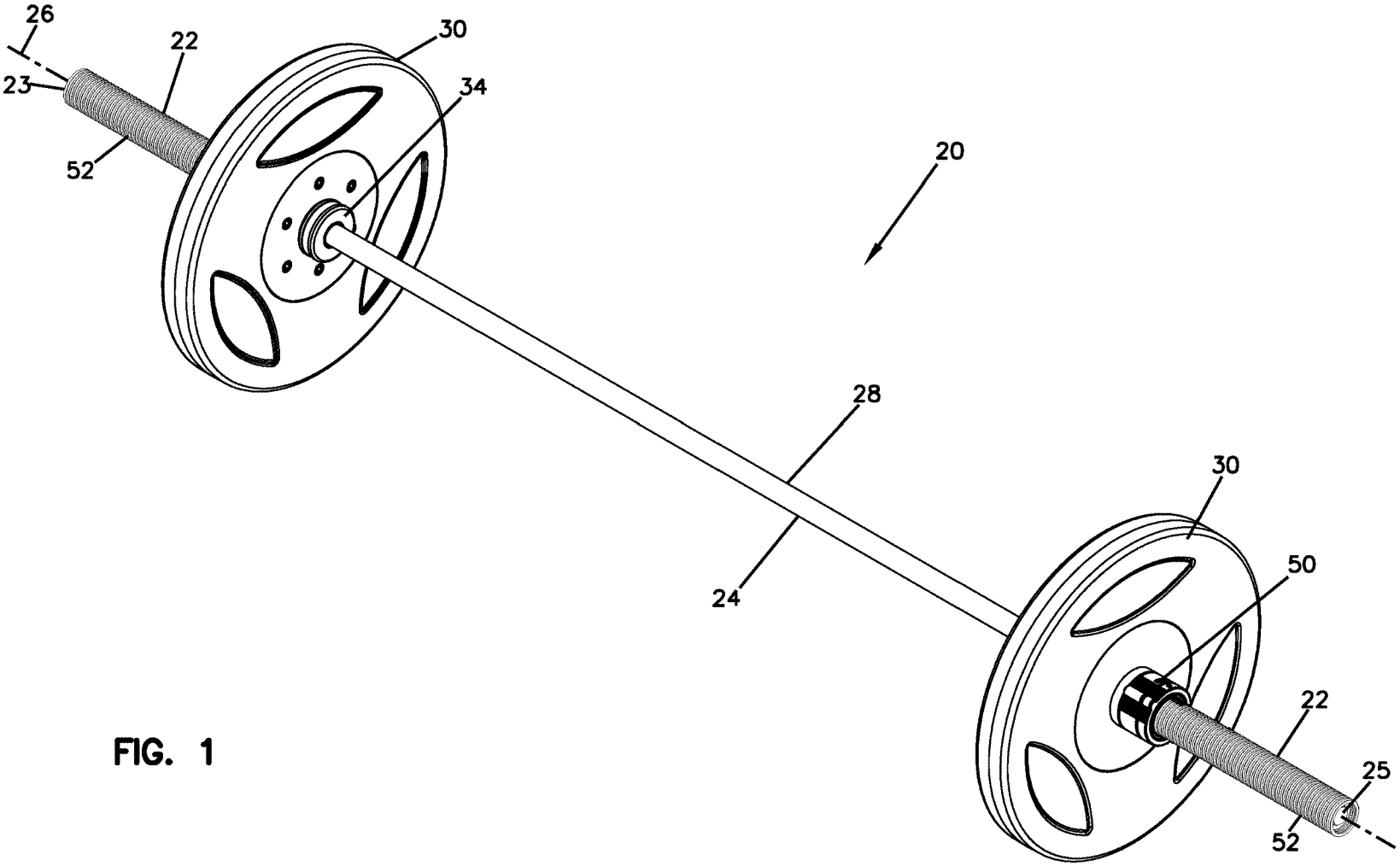
FIG. 1 is a perspective view of a weight bar system including a weight bar, two locking collars, and two weights.
Figure 2:
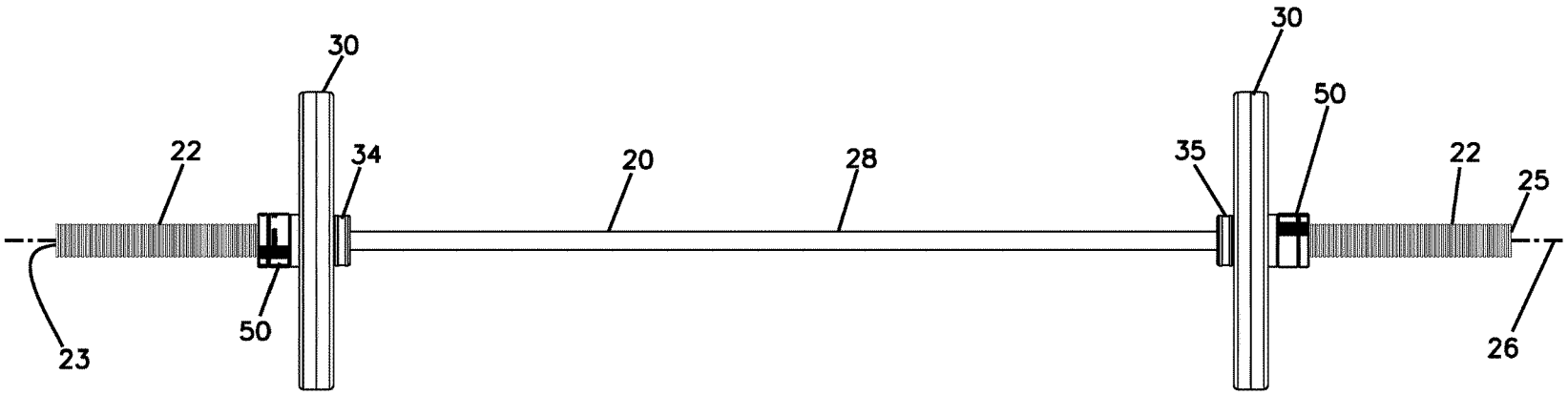
FIG. 2 is another view of the weight bar system of FIG. 1.

As shown in the FIG.s, a weight bar 20 is provided for lifting weights 30 disposed on opposite ends 22 of the weight bar 20. The weights 30 each include a central hole (not visible) which allows for the weight 30 to be mounted on each end 22 of weight bar 20. A lock collar 50 is provided on each end 22 of weight bar 20 to retain the weights 30 on weight bar 20.

Figure 4:
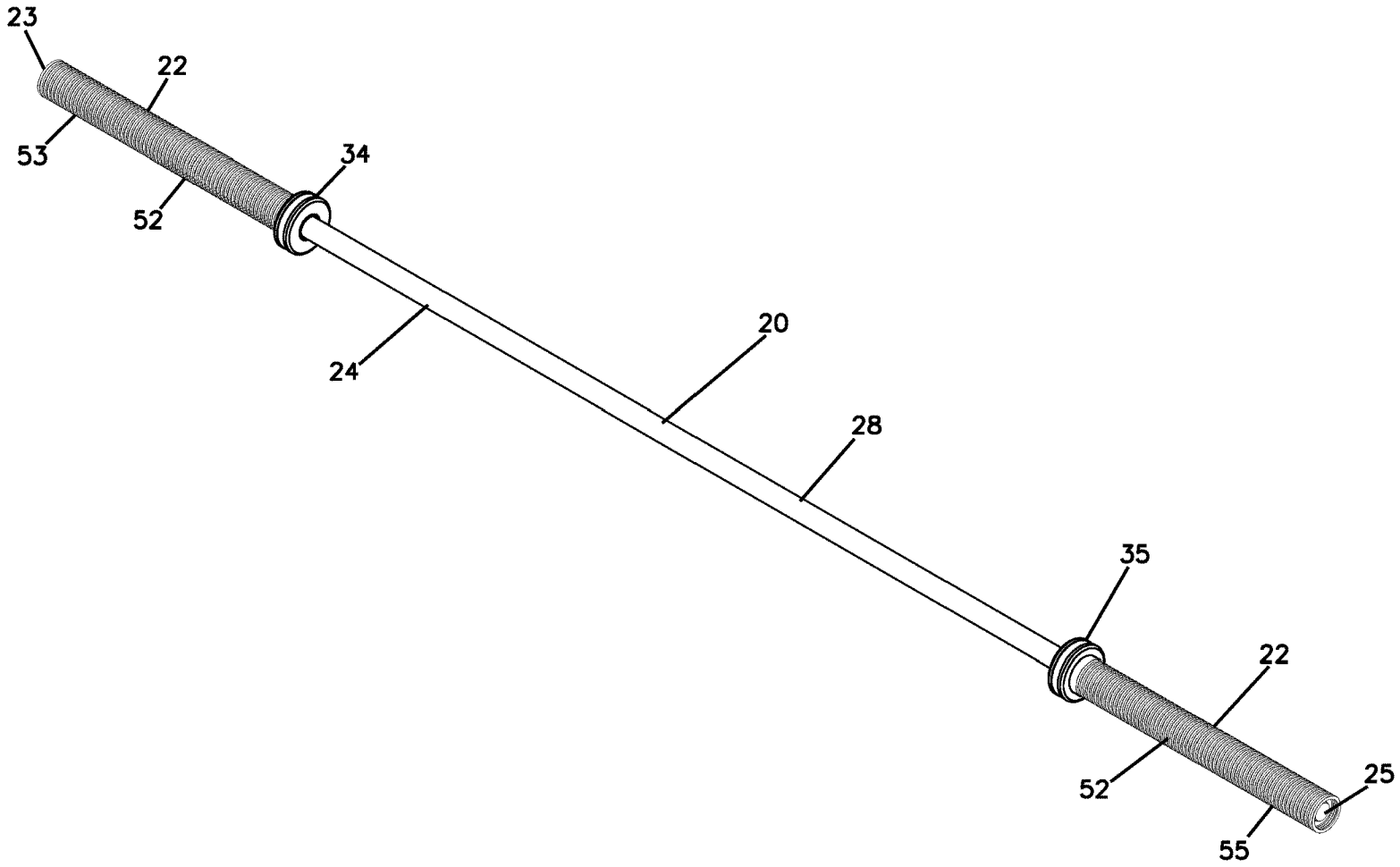
FIG. 4 is a perspective view of the weight bar of the system of FIG. 1.

Weight bar 20 includes a main body portion 24 which extends along an axis 26. A grasping portion 28 is in the middle area or section of weight bar 20. A first stop member 34 is on the main body portion 24 and is spaced from a first end 23. The first stop member 34 is adjacent to the grasping portion 28. A second stop member 35 is on the main body portion 24 and is spaced from a second end 25 adjacent to the grasping portion 28. The grasping portion 28 can be seen in FIG. 4 as being between the first stop member 34 and the second stop member 35.

Figure 5:
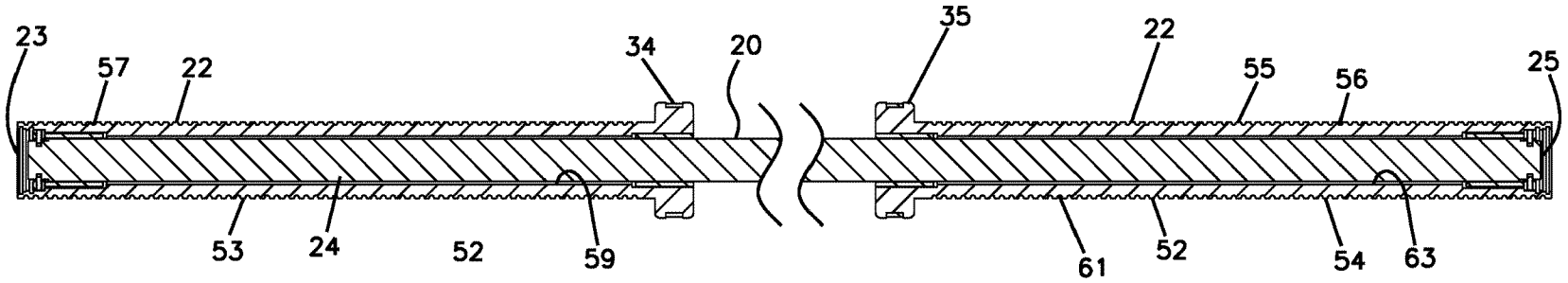
FIG. 5 is a cross-sectional view of the weight bar of FIG. 4.

Each end 22 of bar 20 is provided with grooves 52 which extend circumferentially around distal ends 22. Grooves 52 include a series of alternating peaks 54 and channels or valleys 56 (FIG. 5). The grooves 52 are part of a first grooved section 53 and a second grooved section 55. The first grooved section 53 has at least thirty spaced grooves extending between the first end 23 and the first stop member 34. The second grooved section 55 has at least thirty spaced grooves extending between the second end 25 and the second stop member 35.

Figure 6:
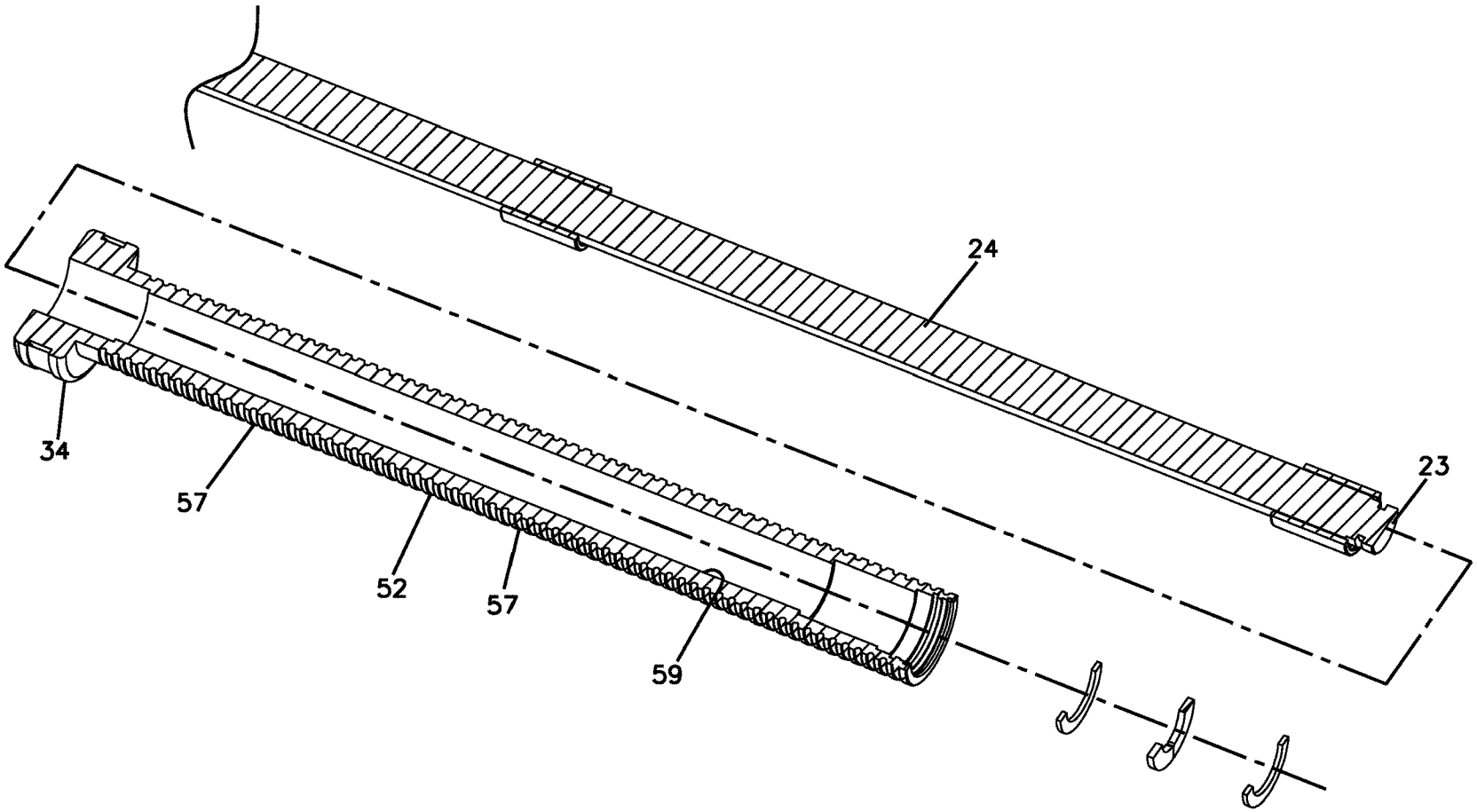
FIG. 6 is an exploded view of an end portion of the weight bar in cross-section.
Figure 7:
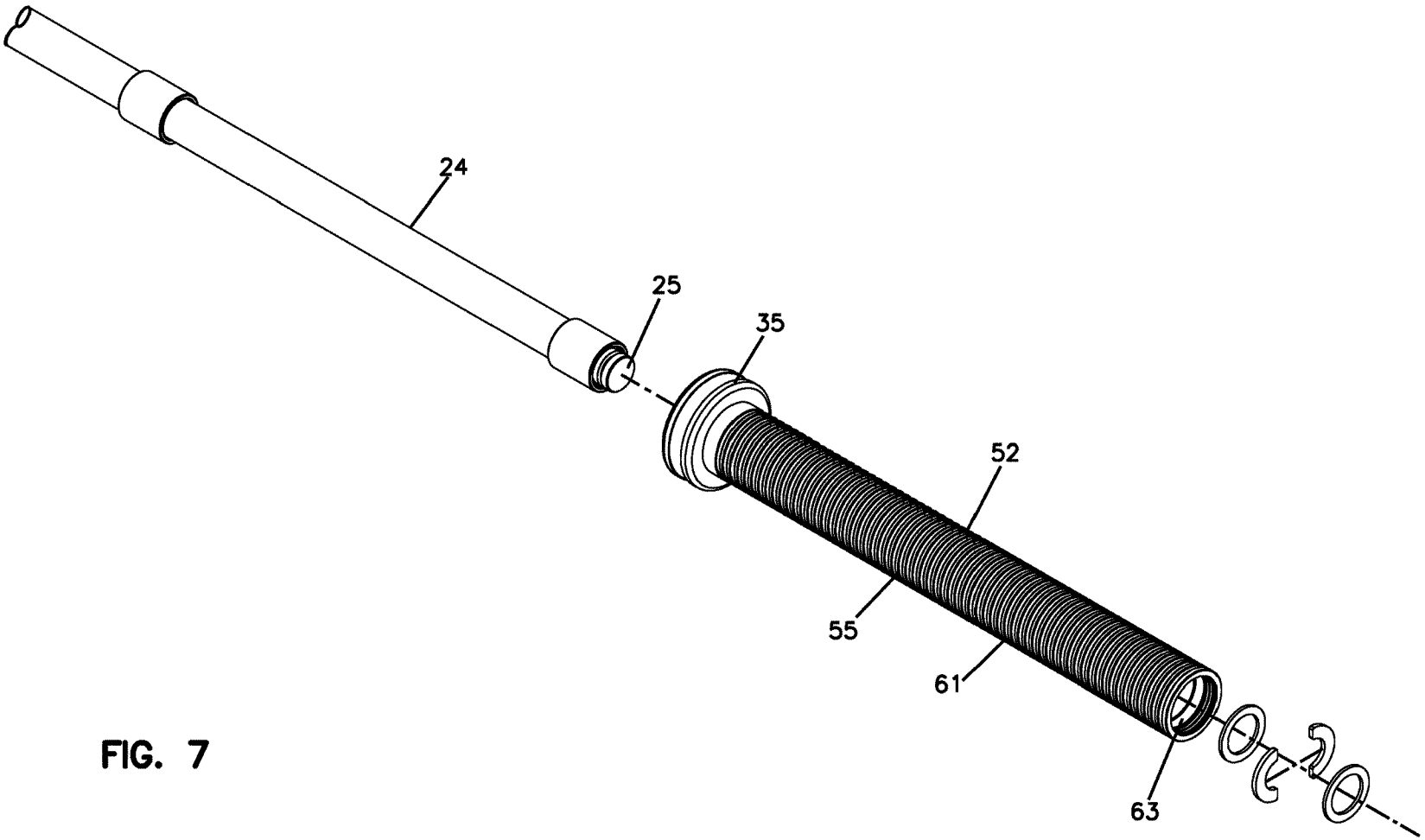
FIG. 7 is a further exploded view of the end of the weight bar.

Attention is directed to FIGS. 5-7. The first stop member 34 and the first grooved section 53 are part of a first sleeve 57. The first sleeve 57 has an open inner bore 59. The main body portion 24 of the weight bar 20 is received within the open inner bore 59 of the first sleeve 57. Similarly, the second stop member 35 and the second grooved section 55 are part of a second sleeve 61 having an open inner bore 63. The main body 24 is received within the open inner bore 63 of the second sleeve 61.

In reference to FIG. 5, it can be seen how the first sleeve 57 extends axially beyond the first distal end 23. The second sleeve 61 extends axially beyond the second distal end 25.

Still in reference to FIG. 5, the grooves 52 in the first grooved section 53 are evenly spaced and occupy a complete extension between the first end 23 and the first stop member 34. The grooves 52 in the second grooved section 55 are evenly spaced and occupy a complete extension between the second end 25 and the second stop member 35.

Still in reference to FIG. 5, the first and second top members 34, 35 project outwardly from the main body portion 24 further than a radial projection of the first and second grooved sections 53, 55.

Figure 3:
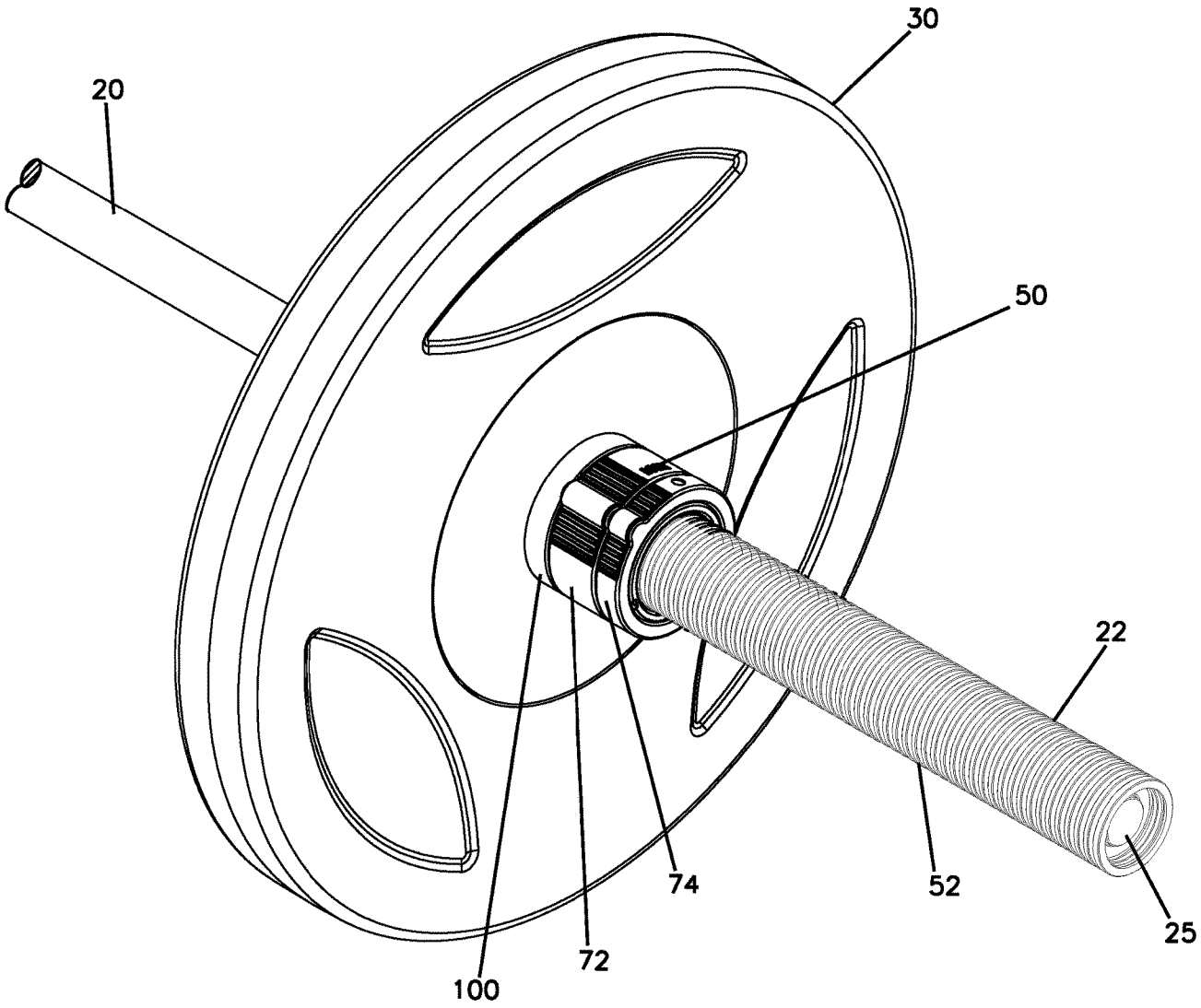
FIG. 3 is a portion of one end of the weight bar system of FIG. 1.

In FIG. 3, it can be seen how the lock collar 50 engages grooves 52 to lock weights 30 to weight bar 20.

Figure 8:
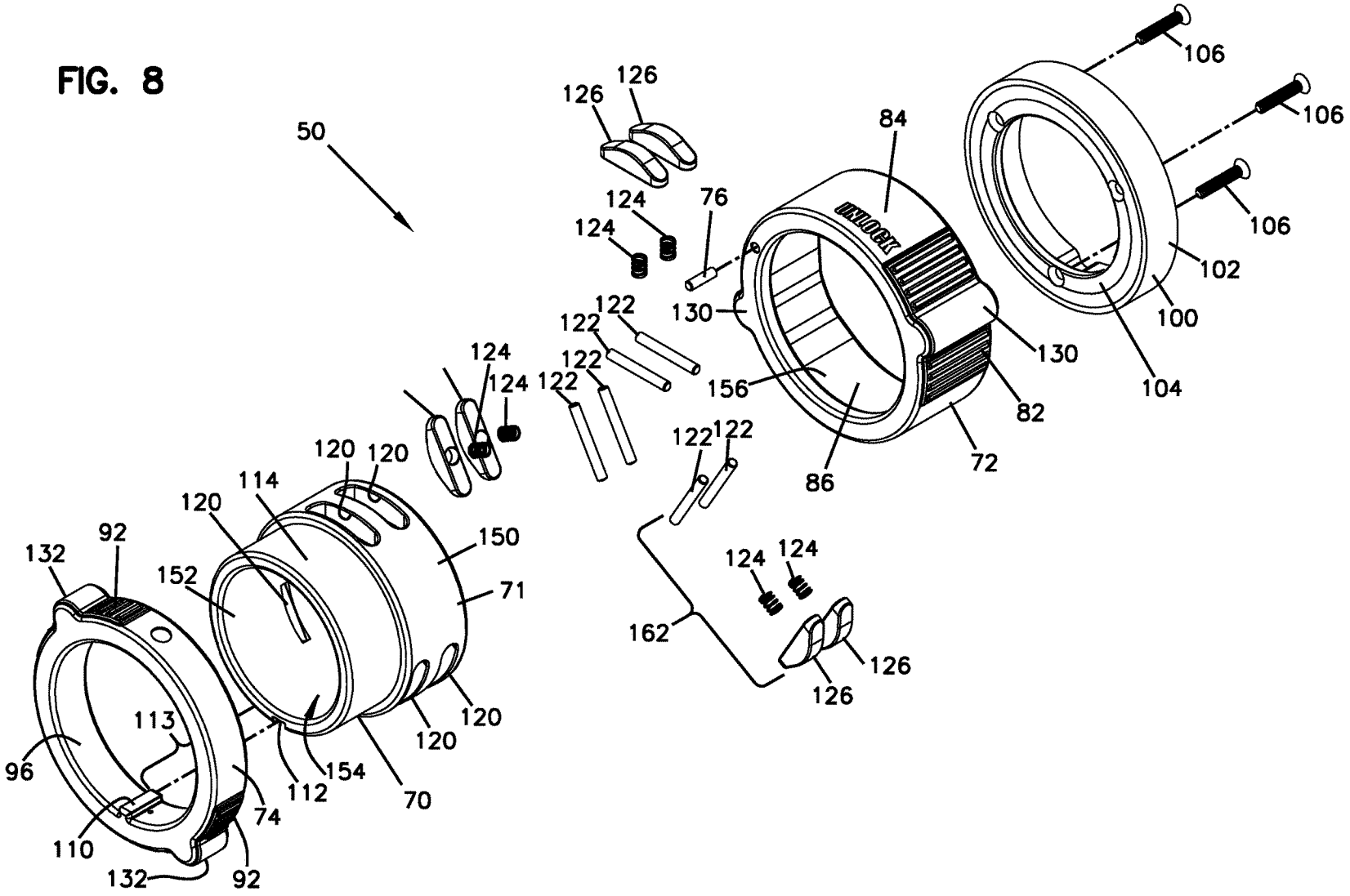
FIG. 8 is an exploded view of the lock collar.
Figure 9:
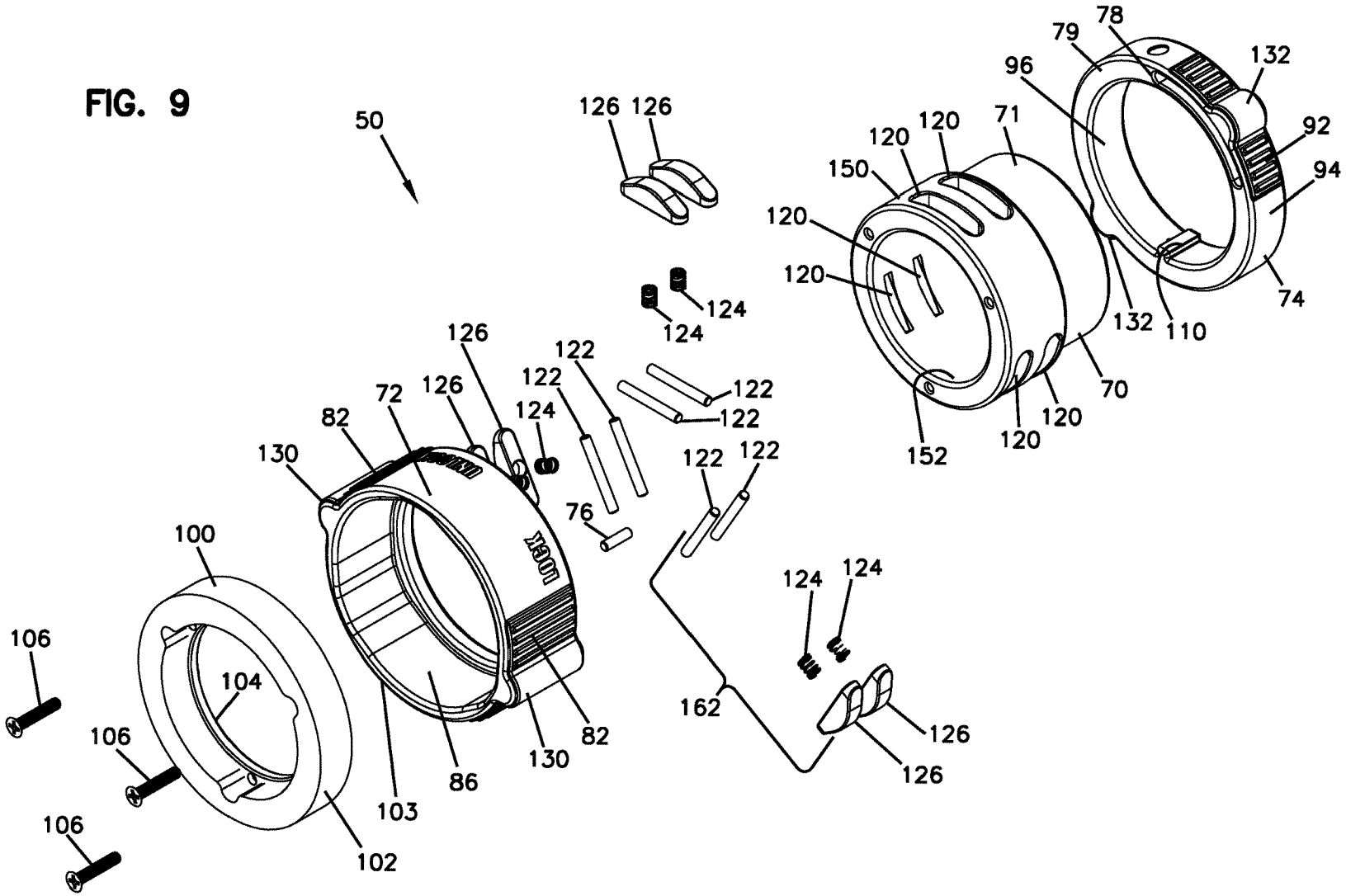
FIG. 9 is another exploded view of the lock collar.
Figure 11:
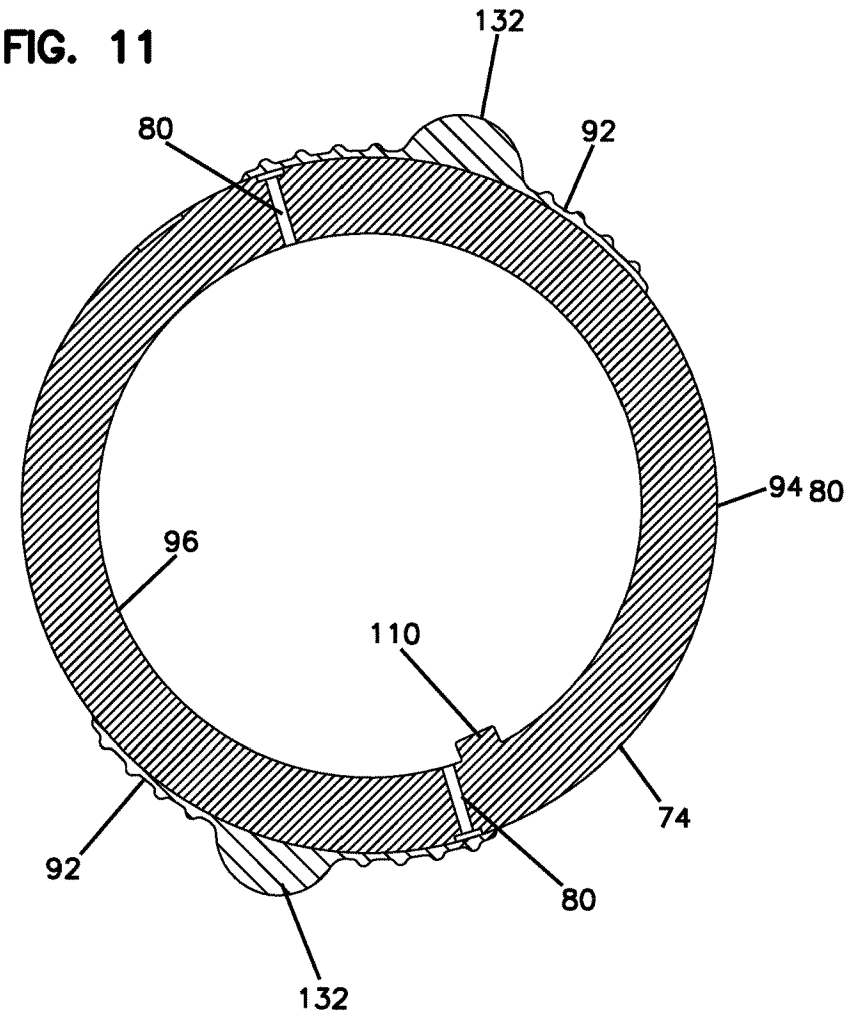
FIG. 11 is a cross-sectional view of the stationary collar taken along lines 11-11 of FIG. 10.
Figure 10:
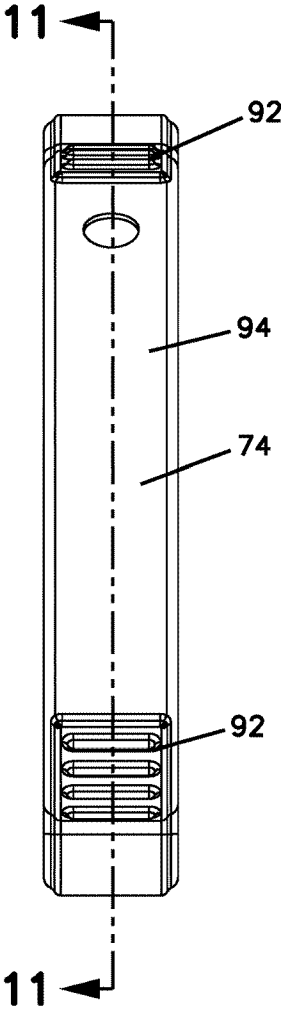
FIG. 10 is a side view of the stationary collar of the lock collar.

Reference is now made to FIGS. 8 and 9. Lock collar 50 includes a main body or main collar 70, a rotating collar 72, and a stationary collar 74. Rotating collar 72 includes an axially projecting pin 76 which is received in a slot 78 in an axial surface 79 on stationary collar 74 for limiting rotation of rotating collar 72 to a predefined amount. Rotating collar 72 includes gripping portions 82 on an exterior surface 84. The gripping portions 82 may each include a gripping tab 130. Stationary collar 74 includes gripping portions 92 on an exterior surface 94. The gripping portions 92 may each include a gripping tab 132.

In reference now to FIG. 8, the main body 70 of the lock collar 50 is generally a cylindrical wall 71 with an exterior surface 150 and an interior surface 152. The main body 70 also defines an open interior 154 which is circumscribed by the interior surface 152. The side slots 120 extend through the cylindrical wall 71 of the main body 70 from the exterior surface 150 to the open interior 154. The open interior 154 is sized to receive the weight bar 20.

Figure 15:
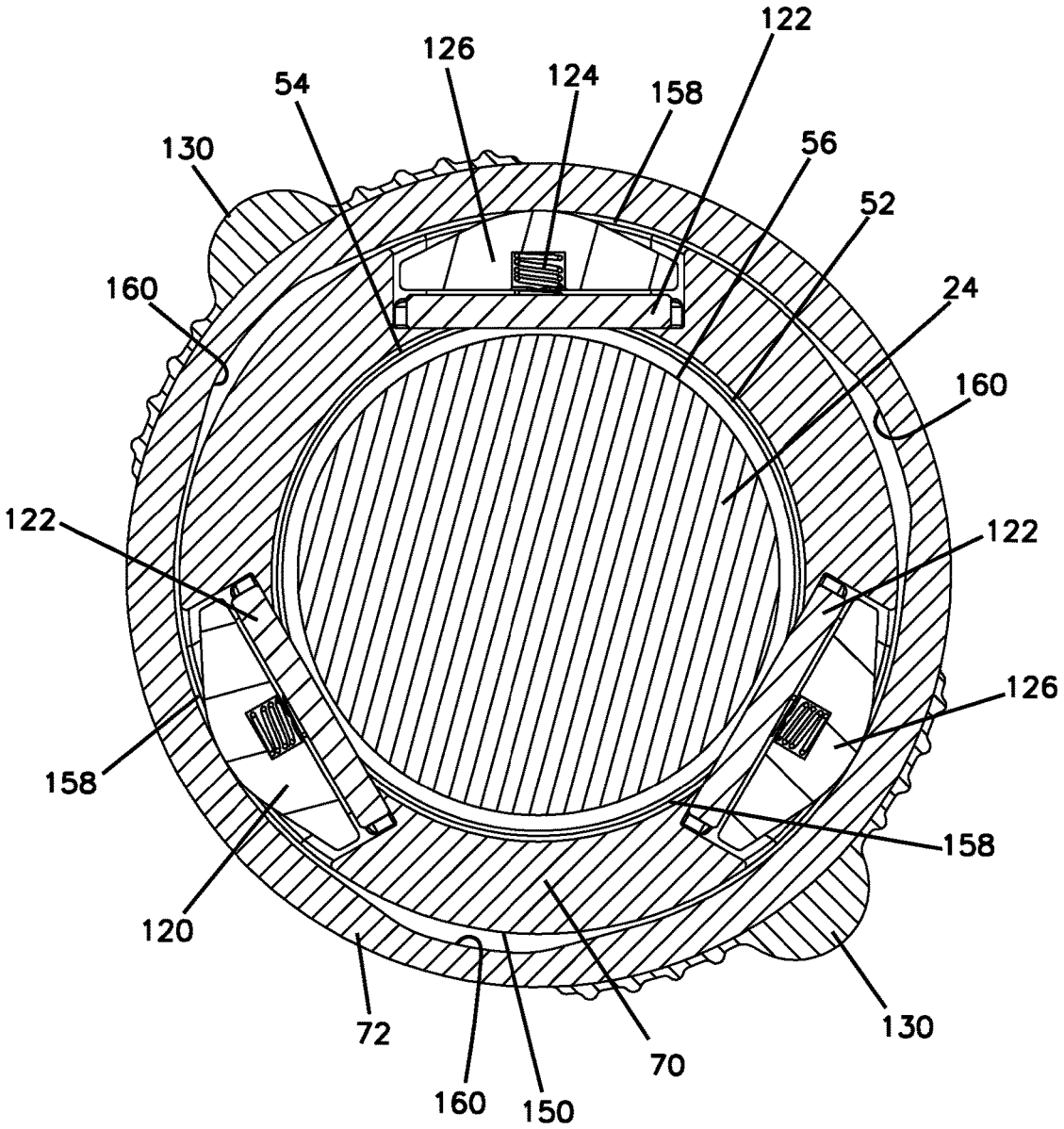
FIG. 15 shows the lock collar of FIG. 14, in cross-sectional view mounted over the weight bar and the pins locked into grooves.

The rotatable collar 72 has an inner ring-shaped surface 156, which includes inner cam surface 86. The inner cam surface 86 has a plurality of radially inward projections 158 (FIG. 15) and radially outward recesses 160 (FIG. 15). The rotatable collar 72 is oriented around and against the exterior surface 150 of the main body 70.

Lock collar 50 further includes an end portion 100 including a spacer 102 and an end cap 104. In one embodiment, spacer 102 is resilient and can be compressed. End cap 104 in one embodiment can be made from nylon and can be co-molded with spacer 102. Fasteners 106 mount end cap 104 to main body 70. The spacer 102 is mounted along an axial end 103 (FIG. 9) of the rotatable collar 72. The rotatable collar 72 is axially between the spacer 102 and the stationary collar 74.

Stationary collar 74 includes an inner key 110 on an inner surface 96 which is received in a slot 112 on an exterior surface 114 of main body 70 forming a key and slot arrangement 113. The key and slot arrangement 113 prevents relative rotation of stationary collar 74 and main body 70. Additionally, fasteners can extend radially through stationary collar 74 through holes 80 to engage exterior surface 114 of main body 70 to further hold stationary collar 74 to main body 70.

Figure 12:
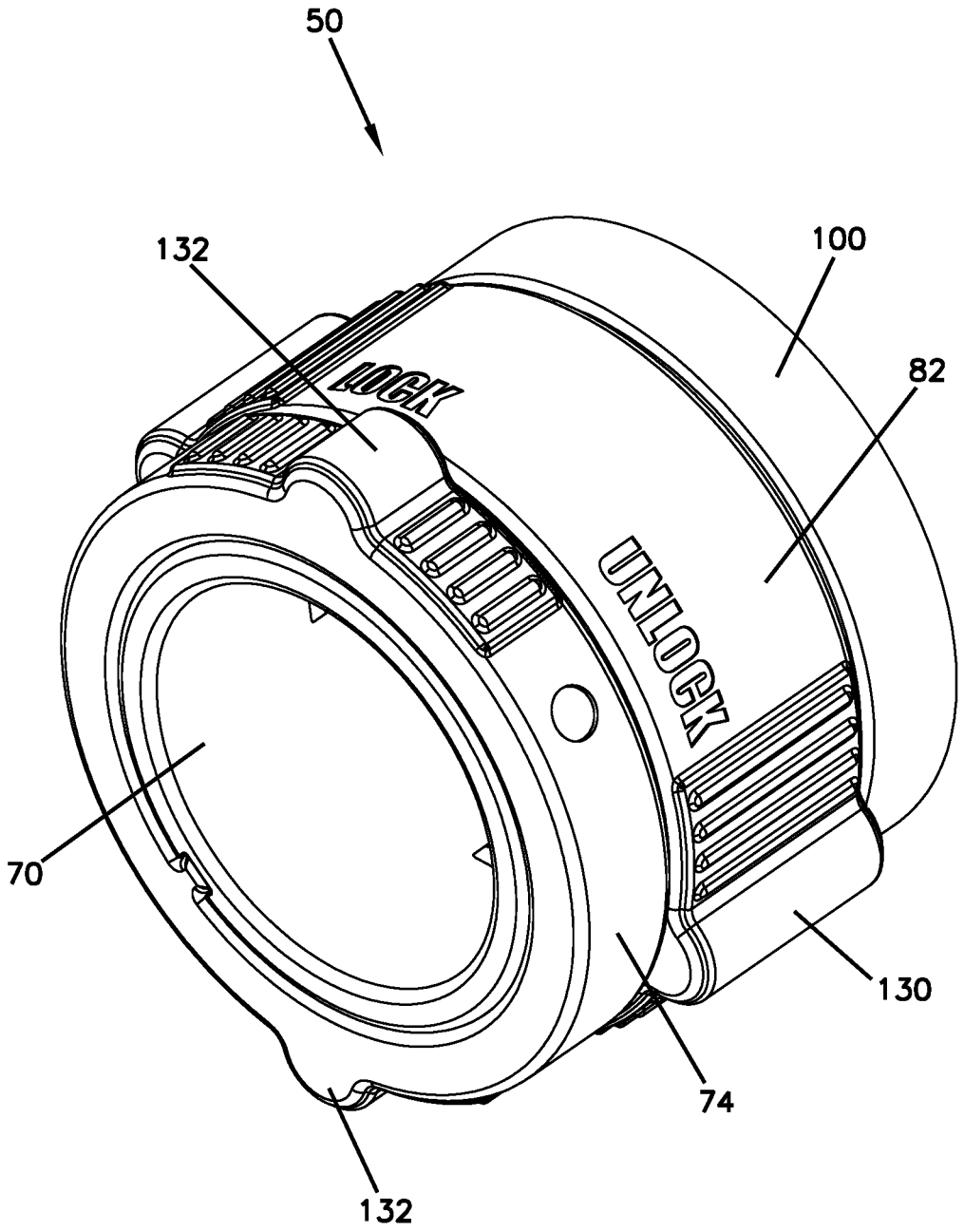
FIG. 12 shows the lock collar in the unlocked position.
Figure 13:
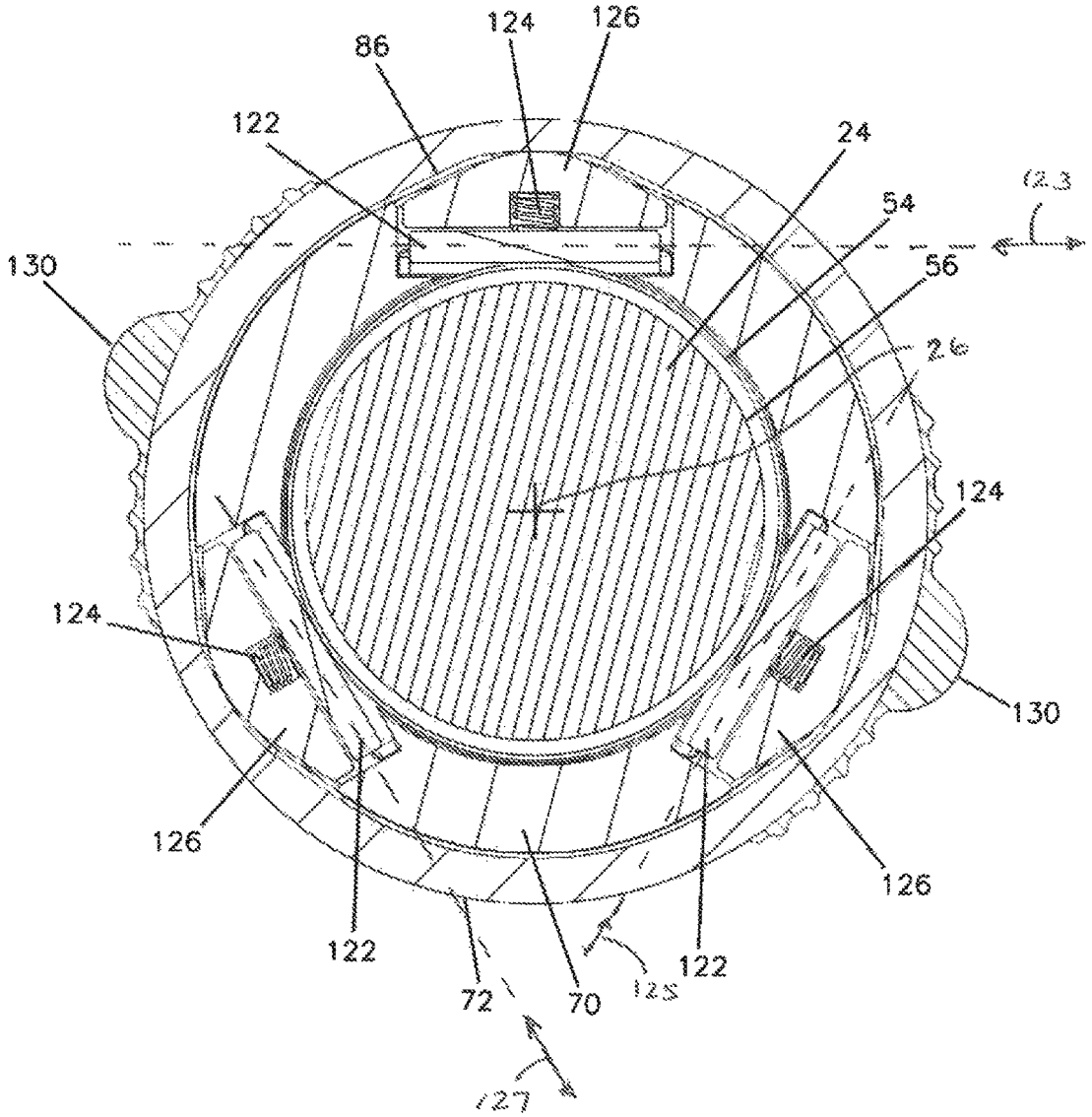
FIG. 13 shows the lock collar of FIG. 12 in cross-sectional view, mounted on the weight bar and showing the pins moved upwardly.
Figure 14:
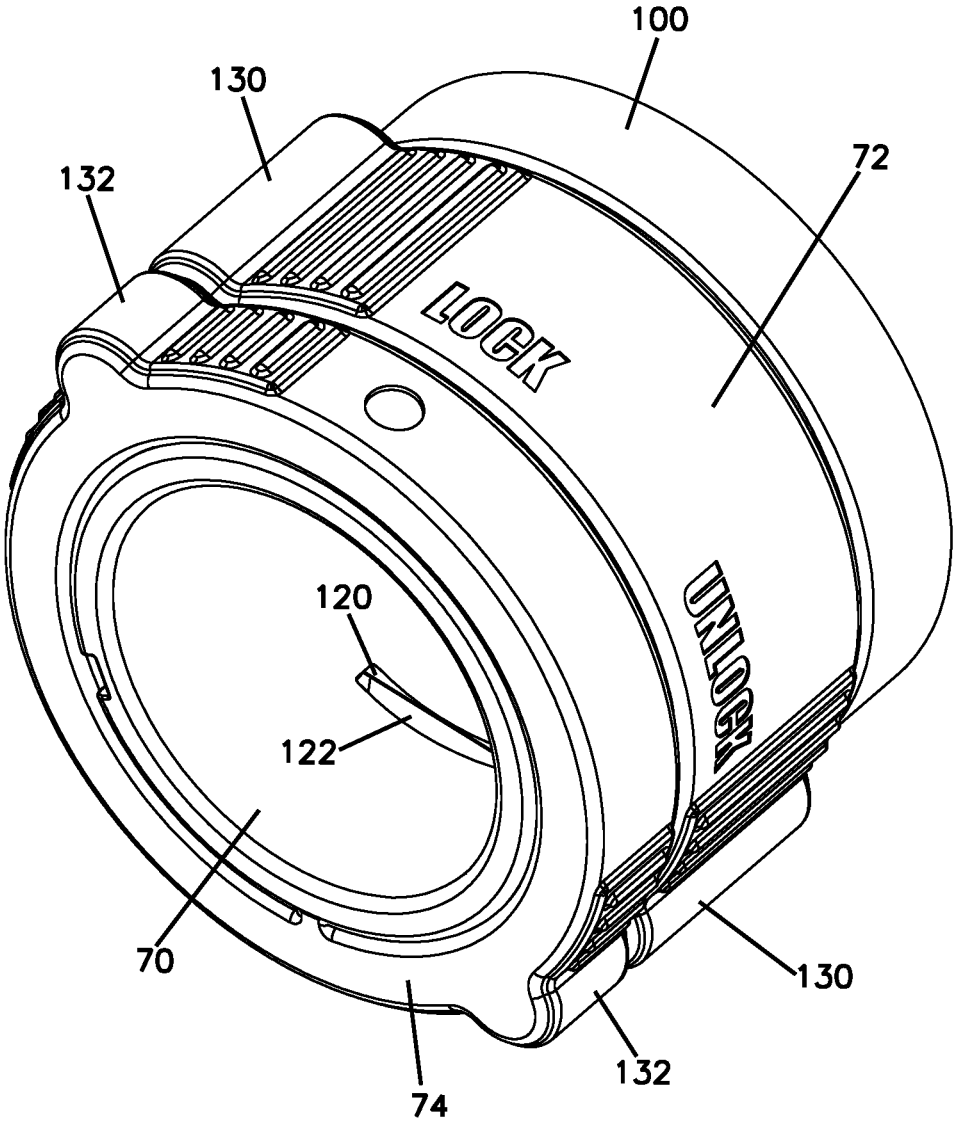
FIG. 14 shows the lock collar in the locked position.

The lock collar 50 further includes a plurality of cam assemblies 162. Each cam assembly 162 is oriented in a respective one of the side slots 120 of the main body 70. Each cam assembly 162 is movable by the cam surface 86 of the rotatable collar 72 between a locked position (FIGS. 14 and 15) and an unlocked position (FIGS. 12 and 13). The locked position (FIGS. 14 and 15) includes the cam assembly 162 as being prevented from moving radially outwardly from the main body 70. The unlocked position (FIGS. 12 and 13) includes the cam assembly 162 being free to move radially outwardly from the main body 70.

While many embodiments are possible, in this embodiment, each cam assembly 162 includes an elongate member such as a linear pin 122, a spring 124, and a cam member 126. The linear pin 122 is mounted to extend along and through a respective side slot 120. The spring 124 is between the linear pin 122 and the cam member 126. The cam member 126 is in engagement with the cam surface 86 of the rotatable collar 72.

In example implementations, there are at least two side slots 120 and two cam assemblies 162. In the example shown, there are no more than six side slots 120 and six cam assemblies 162. Many variations are possible.

Main body 70 includes side slots 120 which receive pins 122, springs 124 and cams 126. Pins 122 extend in the cross direction 123, 125, 127 (FIG. 13) relative to axis 26. Pins 122 are spring biased by springs 124 radially toward axis 26. Cams 126 (or locks) are selectively movable radially inwardly to lock pins 122 in place, or to allow for pins 122 to move radially outwardly against springs 124. As shown, main body 70 includes six slots120, six pins 122, six springs 124, and six cams 126 wherein the slots 120, pins 122, springs 124, and cams 126 are paired together, and located 120° apart.

As rotating collar 72 is rotated between unlocked and locked positions, an inner cam surface 86 with different radial distances from the axis moves cams 126 radially inwardly to press against pins 122 to prevent outward radial movement. In the locked position, pins 122 reside in one of the low points (e.g., channels or valleys 56) of grooves 52. In the locked position, lock collar 50 cannot be axially moved away from weights 30. As shown, when lock collar 50 is locked, tabs 130 and 132 are in alignment in the axial direction.

By rotating collar 72 to an unlocked position, the cams 126 are no longer forced radially inwardly against pins 122, and the pins 122 can be moved radially outwardly against springs 124 to allow pins 122 to slide along grooves 52 between the low points (channels or valleys 56) and the peaks 54, to allow for sliding axially either toward each weight 30, or away from each weight 30 to allow removal of the lock collar 50, to remove weight 30, or to add an additional weight or weights. Compare FIGS. 13 and 15.

It can be appreciated that when each cam assembly 162 is in the locked position, at least one gripping tab 130, or the pair of gripping tabs 130 of the rotatable collar 72 aligns with the at least one gripping tab 132 or the pair of gripping tabs 132 of the stationary collar 74. When each cam assembly 162 is in the unlocked position, the at least one gripping tab 130 or pair of gripping tabs 130 of the rotatable collar 72 misaligns with the at least one gripping tab 132 or pair of gripping tabs 132 of the stationary collar 74.

One aspect of the invention relates to a lock collar.

Another aspect of the invention relates to a weight bar including grooves on each end.

A further aspect of the invention relates to a combination of a weight bar with grooves and two lock collars.

Another aspect of the invention relates to a combination of a weight bar with grooves, weights, and two lock collars.

A further aspect of the invention relates to methods of use of a weight bar with grooves and two lock collars.

The above can be used in a method of mounting a locking collar onto a weight bar. The method includes providing weight bar 20 having a main body portion 24. The locking collar 50 is provided and has an open passage and the plurality of linear pins 122 projecting radially inwardly into the open passage. The locking collar 50 is moved around at least one distal end 22 so that the weight bar 20 extends through the open passage of the locking collar 50. The locking collar 50 is positioned to a desired location along the weight bar 20 with the linear pins 122 projecting into the circumferential grooves 52. The method includes locking the locking collar 50 to the weight bar 20 by rotating rotatable collar 72, which moves cam surface 86 to engage a plurality of cam members 126 against the linear pins 122 to prevent the pins 122 from moving radially outwardly. The method can further include, after the step of locking, unlocking the locking collar 50 by rotating the rotatable collar 72 to move the cam surface 86 and disengage the cam members 126 from the linear pins 122 to allow the linear pins 122 to move radially outwardly.

The above specification, examples and data provide a complete description of the manufacture and use of the composition of the invention. Many embodiments can be made without departing from the spirit and scope of principles of this disclosure.

What is claimed is:

1. A weight bar locking system comprising:

a weight bar extending in an axial direction and having distal ends, the distal ends including grooves which are circumferentially located about each distal end;

two locking collars for selectively mounting to the distal ends of the weight bar, each locking collar including:

a main body including a plurality of linear pins which extend in a cross direction relative to the axis of the weight bar, the pins movable radially inwardly and outwardly relative to the axis; and a rotatable collar member mounted exterior of the main body in the location of the pins and having an inner cam surface configured to move the pins radially inwardly into the grooves of each distal end of the weight bar; the rotatable collar member being movable between a locked position and an unlocked position, (i) the locked position being when the pins are positioned by the inner cam surface of the rotatable collar member in the grooves of each distal end of the weight bar and are not movable radially outwardly, and (ii) the unlocked position being when the pins are movable radially outwardly from the grooves permitting the locking collar to slide axially along the weight bar.

2. The weight bar system of claim 1, further comprising a stationary collar mounted to the main body, wherein the stationary collar limits the amount of rotation of the rotatable collar member to a predetermined amount.

3. The weight bar system of claim 1, further comprising a cam and a spring wherein the cam engages the rotatable collar member, and wherein the cam presses on the spring which presses on each pin.

4. The weight bar system of claim 3, wherein the main body includes a plurality of transverse slots extending in the cross direction relative to the axis wherein the slots receive the pins, the springs, and the cam elements.

5. The weight bar system of claim 1, further comprising exterior gripping portions on the rotating collar member.

6. The weight bar system of claim 1, wherein the gripping portions include a gripping tab.

7. The weight bar system of claim 1, further comprising a stationary collar including gripping portions.

8. The weight bar system of claim 1, wherein the gripping portions include gripping tabs.

* * * * *